US007165633B2

(12) United States Patent
Hall et al.

(10) Patent No.: US 7,165,633 B2
(45) Date of Patent: Jan. 23, 2007

(54) DRILLING FLUID FILTER

(75) Inventors: David R. Hall, Provo, UT (US); Joe Fox, Spanish Fork, UT (US); Kory Garner, Orem, UT (US)

(73) Assignee: IntelliServ, Inc., Provo, UT (US)

( * ) Notice: Subject to any disclaimer, the term of this patent is extended or adjusted under 35 U.S.C. 154(b) by 282 days.

(21) Appl. No.: 10/711,595

(22) Filed: Sep. 28, 2004

(65) Prior Publication Data

US 2006/0065443 A1 Mar. 30, 2006

(51) Int. Cl.
*E21B 43/34* (2006.01)
*E21B 43/00* (2006.01)

(52) U.S. Cl. ..... 175/314; 166/228

(58) Field of Classification Search ..... 166/228; 175/314, 321, 322

See application file for complete search history.

(56) References Cited

U.S. PATENT DOCUMENTS

| | | | | |
|---|---|---|---|---|
| 2,414,719 | A | 1/1947 | Cloud | |
| 2,764,388 | A * | 9/1956 | Camp | 175/259 |
| 3,518,608 | A | 6/1970 | Papadopouloa | |
| 4,495,073 | A | 1/1985 | Belmgraben | |
| 4,739,325 | A | 4/1988 | MacLeod | |
| 4,788,544 | A | 11/1988 | Howard | |
| 6,012,015 | A | 1/2000 | Tubel | |
| 6,252,518 | B1 | 6/2001 | Laborde | |
| 6,392,317 | B1 | 5/2002 | Hall et al. | |
| 6,589,685 | B1 | 7/2003 | Mizuno et al. | |
| 6,598,685 | B1 * | 7/2003 | Mashburn | 175/57 |
| 6,670,880 | B1 | 12/2003 | Hall et al. | |
| 6,684,951 | B1 | 2/2004 | Restarick | |
| 6,688,396 | B1 | 2/2004 | Floerke et al. | |
| 6,717,501 | B1 | 4/2004 | Hall et al. | |
| 6,799,632 | B1 | 10/2004 | Hall et al. | |
| 6,821,147 | B1 | 11/2004 | Hall et al. | |
| 6,830,467 | B1 | 12/2004 | Hall et al. | |
| 6,844,498 | B1 | 1/2005 | Hall et al. | |
| 6,866,306 | B1 | 3/2005 | Boyle et al. | |
| 6,888,473 | B1 | 5/2005 | Hall et al. | |

(Continued)

OTHER PUBLICATIONS

PCT/US03/16475, Published Dec. 4, 2003, Applicant Baker Hughes; International Search Report; "Documents Considered to Be Relevant".

*Primary Examiner*—David Bagnell
*Assistant Examiner*—Brad Harcourt
(74) *Attorney, Agent, or Firm*—Jeffery E. Daly; Tyson J. Wilde

(57) ABSTRACT

A drilling fluid filter for placement within a bore wall of a tubular drill string component comprises a perforated receptacle with an open end and a closed end. A hanger for engagement with the bore wall is mounted at the open end of the perforated receptacle. A mandrel is adjacent and attached to the open end of the perforated receptacle. A linkage connects the mandrel to the hanger. The linkage may be selected from the group consisting of struts, articulated struts and cams. The mandrel operates on the hanger through the linkage to engage and disengage the drilling fluid filter from the tubular drill string component. The mandrel may have a stationary portion comprising a first attachment to the open end of the perforated receptacle and a telescoping adjustable portion comprising a second attachment to the linkage. The mandrel may also comprise a top-hole interface for top-hole equipment.

20 Claims, 10 Drawing Sheets

U.S. PATENT DOCUMENTS

| | | | |
|---|---|---|---|
| 6,913,093 | B1 | 7/2005 | Hall et al. |
| 6,929,493 | B1 | 8/2005 | Hall et al. |
| 6,945,802 | B1 | 9/2005 | Hall et al. |
| 6,968,611 | B1 | 11/2005 | Hall et al. |
| 2004/0039466 | A1 | 2/2004 | Lilly et al. |
| 2004/0104797 | A1 | 6/2004 | Hall et al. |
| 2004/0113808 | A1 | 6/2004 | Hall et al. |
| 2004/0145492 | A1 | 7/2004 | Hall et al. |
| 2004/0150532 | A1 | 8/2004 | Hall et al. |
| 2004/0164833 | A1 | 8/2004 | Hall et al. |
| 2004/0164838 | A1 | 8/2004 | Hall et al. |
| 2004/0216847 | A1 | 11/2004 | Hall et al. |
| 2004/0244916 | A1 | 12/2004 | Hall et al. |
| 2004/0244964 | A1 | 12/2004 | Hall et al. |
| 2004/0246142 | A1 | 12/2004 | Hall et al. |
| 2005/0001735 | A1 | 1/2005 | Hall et al. |
| 2005/0001736 | A1 | 1/2005 | Hall et al. |
| 2005/0001738 | A1 | 1/2005 | Hall et al. |
| 2005/0035874 | A1 | 2/2005 | Hall et al. |
| 2005/0035875 | A1 | 2/2005 | Hall et al. |
| 2005/0035876 | A1 | 2/2005 | Hall et al. |
| 2005/0036507 | A1 | 2/2005 | Hall et al. |
| 2005/0039912 | A1 | 2/2005 | Hall et al. |
| 2005/0045339 | A1 | 3/2005 | Hall et al. |
| 2005/0046588 | A1 | 3/2005 | Hall et al. |
| 2005/0046590 | A1 | 3/2005 | Hall et al. |
| 2005/0067159 | A1 | 3/2005 | Hall et al. |
| 2005/0070144 | A1 | 3/2005 | Hall et al. |
| 2005/0082092 | A1 | 4/2005 | Hall et al. |
| 2005/0092396 | A1 | 5/2005 | Hall et al. |
| 2005/0092499 | A1 | 5/2005 | Hall et al. |
| 2005/0095827 | A1 | 5/2005 | Hall et al. |
| 2005/0115717 | A1 | 6/2005 | Hall et al. |
| 2005/0145406 | A1 | 7/2005 | Hall et al. |
| 2005/0150653 | A1 | 7/2005 | Hall et al. |
| 2005/0161215 | A1 | 7/2005 | Hall et al. |
| 2005/0173128 | A1 | 8/2005 | Hall et al. |
| 2005/0212530 | A1 | 9/2005 | Hall et al. |
| 2005/0236160 | A1 | 10/2005 | Hall et al. |
| 2005/0279508 | A1 | 12/2005 | Hall et al. |
| 2005/0284659 | A1 | 12/2005 | Hall et al. |
| 2005/0284662 | A1 | 12/2005 | Hall et al. |
| 2005/0284663 | A1 | 12/2005 | Hall et al. |
| 2005/0285645 | A1 | 12/2005 | Hall et al. |
| 2005/0285705 | A1 | 12/2005 | Hall et al. |
| 2005/0285706 | A1 | 12/2005 | Hall et al. |
| 2005/0285751 | A1 | 12/2005 | Hall et al. |
| 2005/0285752 | A1 | 12/2005 | Hall et al. |
| 2005/0285754 | A1 | 12/2005 | Hall et al. |

* cited by examiner

DRILLING FLUID FILTER

FEDERAL SPONSORSHIP

This invention was made with government support under Contract No. DE-FC26-01 NT41229 awarded by the U.S. Department of Energy. The government has certain rights in the invention.

BACKGROUND OF THE INVENTION

As drilling mud is recirculated during drilling, debris from earth formations may damage sensitive downhole equipment. Filters used to collect the debris and thereby provide a way of removing the debris are known in the art. Often these filters will attach in single shouldered pipe such as described in U.S. Pat. No. 4,495,073 . The '073 patent discloses a mud screen for installation between any two selected ends of interconnected pipes comprising a supporting collar anchored in the selected threaded connection of the drill pipe string and a screen support mounted on such collar and secured thereto by one or more releasing devices. An apertured inverted conical screen is supported by the screen support in transverse relationship to the pipe bore. A bridging element is secured across the screen support and defines a mounting for an upstanding post which functions as a manual handle and also defines a fishing neck at its upper end for downhole retrieval.

U.S. Pat. No. 6,598,685 discloses another system for mounting a filter in a drill string. Disclosed is an apparatus comprising a cylindrical flange member having a first and second passage and a cylindrical sleeve having an internal fishing neck. An attachment pin attaches the flange member to the cylindrical sleeve. The apparatus further comprises a screen member attached to the cylindrical sleeve. In one embodiment, the first and second passages are disposed off-centered so that four bore holes are created. The attachment pin cooperates with a groove formed on the sleeve's outer diameter surface. The apparatus may further include a pulling tool. The pulling tool contains a plurality of dog members disposed about the mandrel, and a spring that urges the dog members into engagement with a protuberance on the mandrel. The apparatus further comprises a shear pin attaching the dog members to the mandrel and wherein the shear pin is disposed within a slot so that the dog members can move axially relative to the mandrel.

U.S. Pat. No. 6,769,484 discloses a downhole expandable bore liner and well screen filter assembly that has a perforated tubular base-pipe overlain with a self expanding filter-cover. A set of runners or bumpers extend the length of the outside of the filter-cover. A releaseable constriction mechanism holds the liner/filter assembly in a compressed configuration during insertion of the assembly down a well bore to facilitate insertion of the liner/filter assembly into its downhole position. Once positioned downhole in the well bore, the mechanism is released, and the liner/filter assembly takes its expanded or uncompressed configuration and interfaces with the walls of the well bore. In its uncompressed configuration, the liner/filter assembly can contact and press against the walls of the well bore, which contact serves to stabilize the assembly and to center it in the downhole well bore. The resilient and malleable nature of the filter material of the filter-cover can engage and at least partially fill and stabilize the irregularities in the formation wall of the well bore. Additionally, the resilient and malleable nature of the filter material of the filter-cover allows the assembly to utilize an expandable base-pipe in complement with the expandable filter material.

BRIEF SUMMARY OF THE INVENTION

A drilling fluid filter for placement within a bore wall of a tubular drill string comprises a perforated receptacle with an open end and a closed end. A hanger for engagement with the bore wall is mounted at the open end of the perforated receptacle. A mandrel is adjacent and attached to the open end of the perforated receptacle. A linkage connects the mandrel to the hanger. The linkage may be selected from the group consisting of struts, articulated struts and cams. The mandrel operates on the hanger through the linkage to engage and disengage the drilling fluid filter from the tubular drill string component.

It should be notes that a perforated receptacle means a receptacle comprising a plurality of orifices of circular shape, rectangular shape, amorphous shape, conical shape and any other know shape known in the art.

The hanger may comprise an engaging surface for attachment to the bore wall. The hanger may be selected from the group consisting of rough surfaces, locks, struts, and a plurality of overlapping plates. The drill string component may be a drill pipe, an internally upset drill pipe, swivel, drill collar, or downhole tools. Preferably, the filter is installed in the drill string component near the opening of the well bore so that is may be retrieved easily; however, more than one filter may be distributed in a drill string. Drill string equipment located downhole may be particularly sensitive to debris and a filter may be located proximate that equipment. If a filter is located downhole another filter may be located up hole where it is easier to retrieve since a downhole filter may be harder to retrieve. The filter downhole may collect significantly less debris and not require replacement as rapidly as the up hole filter.

The mandrel may comprise a stationary portion comprising a first attachment to the open end of the perforated receptacle and a telescoping adjustable portion comprising a second attachment to the linkage. The adjustable portion of the mandrel may comprise a first coaxial position, which engages the hanger against the bore wall, and a second coaxial position which disengages the hanger from the bore wall. The hanger may be engaged against the bore wall by compression. The hanger may be engaged against an internal shoulder of the bore wall, an internal upset of the bore wall, grooves in the bore wall, or an internal diameter of the bore wall.

Disclosed is a filter with a mandrel that extends beyond the open end of the perforated receptacle and the fluid filter may be inserted into a top end of a bore of a drill string component during tripping. The filter may be lowered in a desired distance before the mandrel is operated to engage the bore wall of the drill string component. The filter may be lowered in by top-hole equipment, such as a wire line. The top-hole equipment may attach to the mandrel of the filter at a top-hole interface.

Also disclosed is a filter with a mandrel that extends beyond the closed end of the perforated receptacle and may be inserted into a bottom end of a bore of a drill string component. The mandrel may be operated to engage or disengage the hanger against the bore wall from underneath. In embodiments where the mandrel is telescopic a hammer may be used to engage or disengage the filter.

In some embodiments the mandrel may engage or disengage the filter against the bore wall of the drill string component by rotating the mandrel coaxially. The linkage may be a cam adjacent a lock which will engage the bore wall.

DETAILED DESCRIPTION OF THE INVENTION AND THE PREFERRED EMBODIMENT

Figure 1:
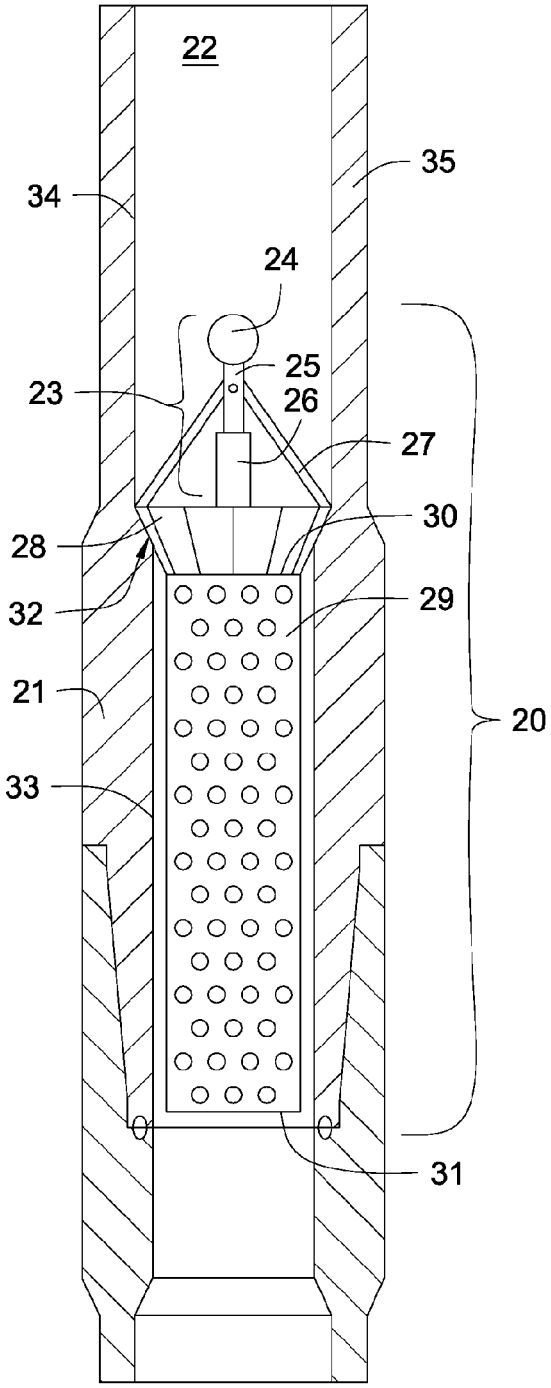
FIG. 1 is an view of a cross section of a drill string component showing a filter of the present invention set in the drill string.

FIG. 1 is an orthogonal view of a filter 20 mounted in a bore 22 within a cross section of a drill string component 21. The filter 20 comprises a perforated receptacle 29 with an open end 30 and a closed end 31. The closed end 31 may also be perforated. The perforated receptacle 29 may comprise a generally cylindrical shape, a generally rectangular shape, a generally conical shape, a generally spherical shape, or an amorphous shape. A hanger 28 is fixedly positioned against an internal upset 32 of the bore wall 35 intermediate a first internal diameter 33 and a second internal diameter 34 of the bore wall 35. The filter 20 further comprises a mandrel 23 with a stationary portion 26 attached to the open end 30 of the filter 20, a telescopic adjustable portion 25 attached to linkages 27, and a top-hole interface 24 for removable attachment to top-hole equipment. The linkages 27 may be selected from the group consisting of struts, articulated struts, and cams. The adjustable portion 25 of the mandrel 23 may move coaxially with respect to the stationary portion 26 of the mandrel 23. As the adjustable portion 25 of the mandrel 23 changes position, the attached linkages 27 pull or push the hanger 28 away from or to the bore wall 35. The drill string component 21 may be selected from the group consisting of drill pipes, internally upset drill pipes, swivels, drill collars, downhole tools, saver subs, and other subs.

Figure 2:
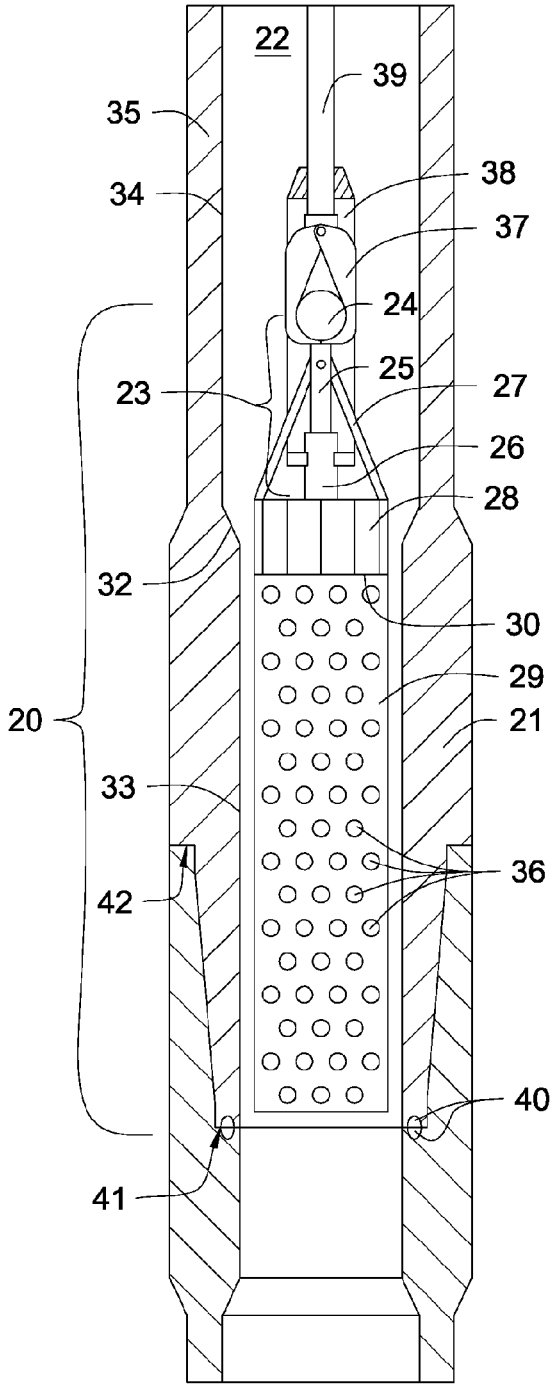
FIG. 2 is an orthogonal view of a filter in a cross section of a drill string component shown released from the drill string.

FIG. 2 shows the telescopic adjustable portion 25 of the mandrel 23 in a position such that the hanger 28 is disengaged from the bore wall 35. Top-hole equipment 39, such as a wire line, comprising a stabilizing hook 38 and a releasing hook 37 is attached to the top-hole interface 24 of the mandrel 23. The stabilizing hook 38 attaches to the stationary portion 26 of the mandrel 23 to stabilize the filter 20. The releasing hook 37 attaches to the top-hole interface 24 and adjusts the position of the adjustable portion 25 of the mandrel 23 with respect to the stationary portion 26 of the mandrel 23. A position change of the adjustable portion 25 of the mandrel 23 may pull the linkages 27 inwardly to release the hanger 28 from the bore wall 35 allowing the filter 20 to be removed from the bore 22 of the drill string component 21.

The filter 20 may be lowered into the bore 22 of a drill string component 21 as show in FIG. 2. In this embodiment the drill string component 21 has a bore wall 35 comprising an internal upset 32 intermediate a first diameter 33 and a second diameter 34. Once the filter 20 is passed the first diameter 33 of the bore wall 35, the adjustable portion 25 of the mandrel 23 may be positioned to push the linkages 27 outward and engage the hanger 28 against the internal upset 32 of the drill pipe 21.

The hanger 28 should be designed to withstand downward force from drilling fluid entering the open end 30 of the perforated receptacle 29 and exiting through the perforations 36 in the receptacle 29. The open end 30 may allow more fluid to enter the receptacle 29 per unit of time than the perforations 36 may allow to exit per unit of time; which may cause the drilling fluid to push downward on the filter 20. Further, the receptacle 29 may collect heavy debris which would increase the weight of the filter 20.

An advantage to hanging a filter 20 on the internal upset 32 of a drill string component 21 is readily apparent in double shouldered pipe, although it may could used in any drill string component 21 comprising an internal bore 22. Several systems for transmitting data or power through a string of drill components 21 comprise transmission elements 40 in the secondary shoulders 41 or primary shoulders 42 of double shouldered pipe. Thus, it is advantageous for a data or power transmission system as disclosed in U.S. Pat. No. 6,670,880 to Hall, et al.; U.S. Pat. No. 6,641,434 to Boyle, et al.; and U.S. Pat. No. 6,688,396 to Floerke, et al.; all of which are herein incorporated by reference; to use a filter 20 attachable to bore wall 35 of a drill component 21 as disclosed in this specification.

Figure 3:
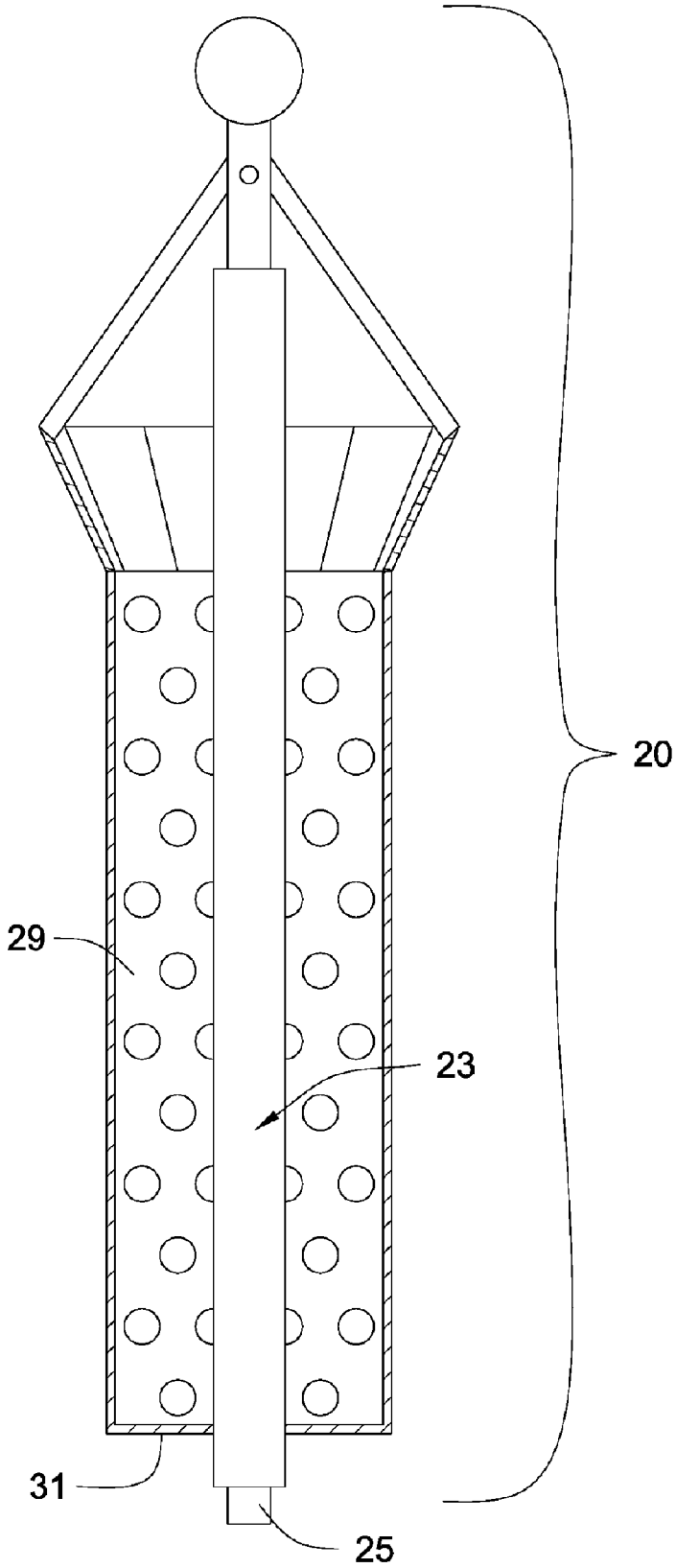
FIG. 3 is a cross sectional view of a filter with a mandrel extending beyond the closed end.

FIG. 3 shows a cross sectional view of a filter 20 that comprises a mandrel 23 that extends beyond the closed end 31 of the receptacle 29. Such a mandrel 23 allows the filter 20 to be installed from the bottom of the drill component 21 (shown in FIG. 1). The adjustable portion 25 of the mandrel 23 may be positioned to engage or disengage the bore wall 35 from underneath. This may be advantageous during tripping where the filter 20 is installed over head in a saver sub or a swivel. A hammer may be used to position the adjustable portion 25 of the mandrel 23. In other embodiments, the filter 20 may be installed from a top end of the drill component 21, where the mandrel 23 extends beyond the open end 30 of the perforated receptacle 29, as shown in FIG. 2.

Figure 4:
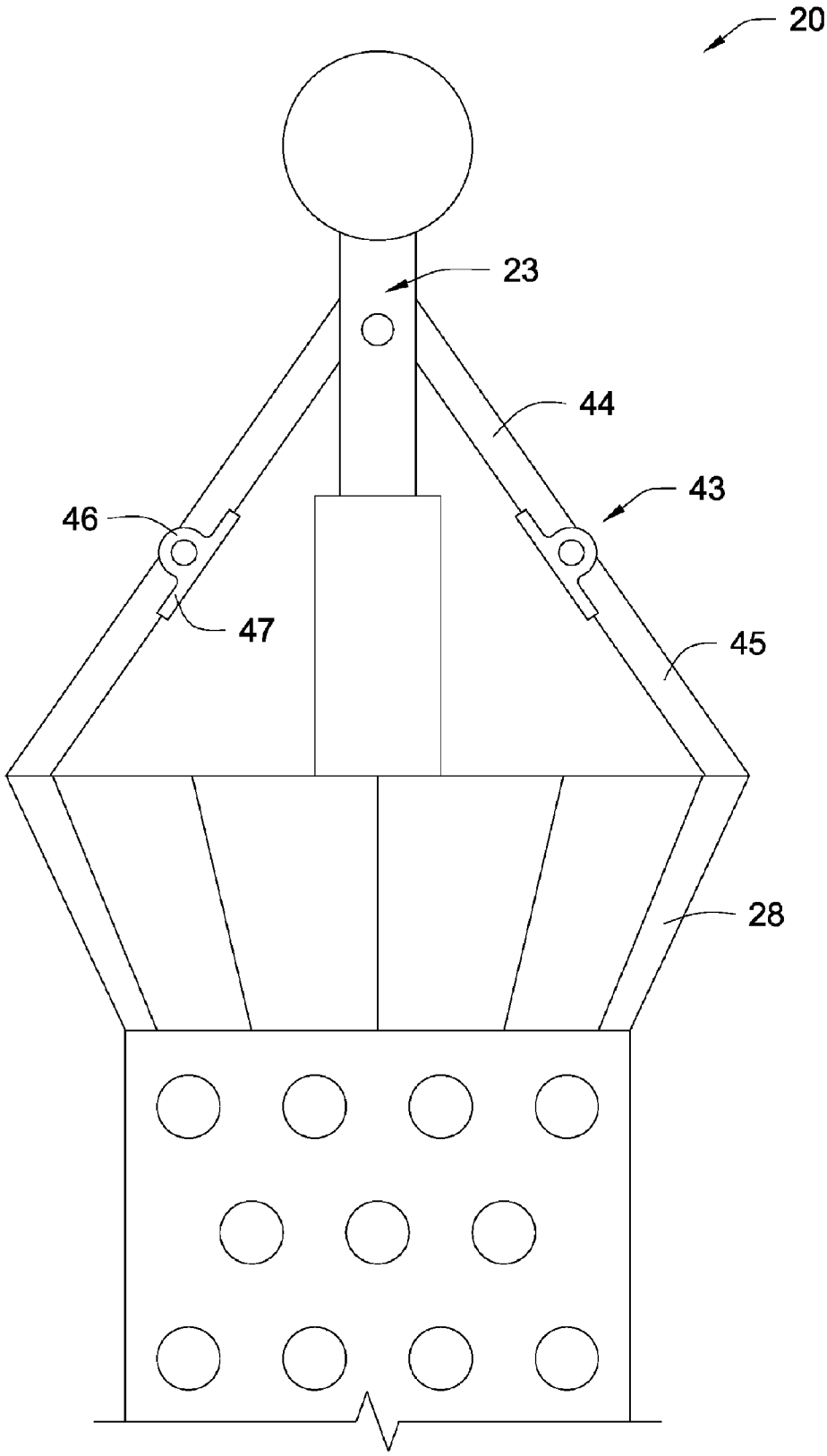
FIG. 4 is a partial orthogonal view of a filter.

FIG. 4 shows a partial view of a filter 20 comprising articulated struts 43. The articulated struts 43 may comprise a first segment 44 attached to the mandrel 23 and a second segment 45 attached to the hanger 28 of the filter 20. A hinge 46 may join the first and second segment 44, 45 of the strut 43. The hinge 46 may comprise a flange 47 to prevent the hinge 46 from bending in undesired directions or to lock the segments 44, 45 of the articulated strut 43 in place. The articulated struts 43 may aid in engaging and disengaging the hanger 28 from the bore wall 35, by helping to adjust the right tension to secure the filter 20 in the bore 22 of the drill component 21 (shown in FIG. 1). The flange 47 of the hinge 46 may be located on a side proximate or distal the mandrel 23.

Figure 5:
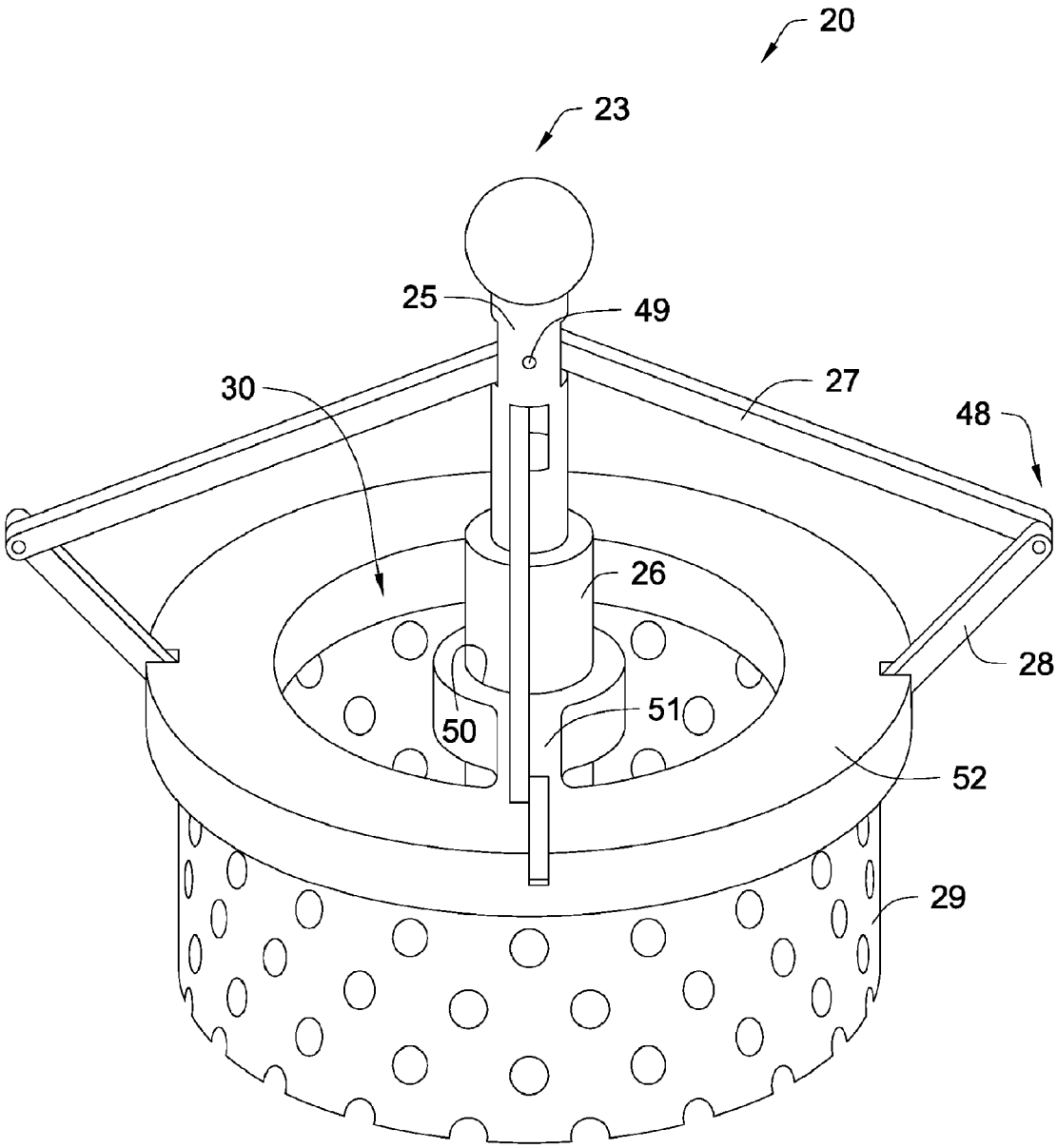
FIG. 5 is a partial perspective view of a filter with articulated struts.

FIG. 5 shows a partial perspective view of a filter 20 comprising a telescopic mandrel 23 with an adjustable portion 25 comprising a second attachment 49 to a linkage 27. The linkage 27 is attached to a hanger 28 by a joint 48. The stationary portion 26 of the mandrel 23 comprises a first attachment 50 to the open end 30 of the perforated receptacle 29 by a bridge 51. The bridge 51 mechanically attaches to the mandrel 23 and to the edge 52 of the receptacle 29.

Figure 6:
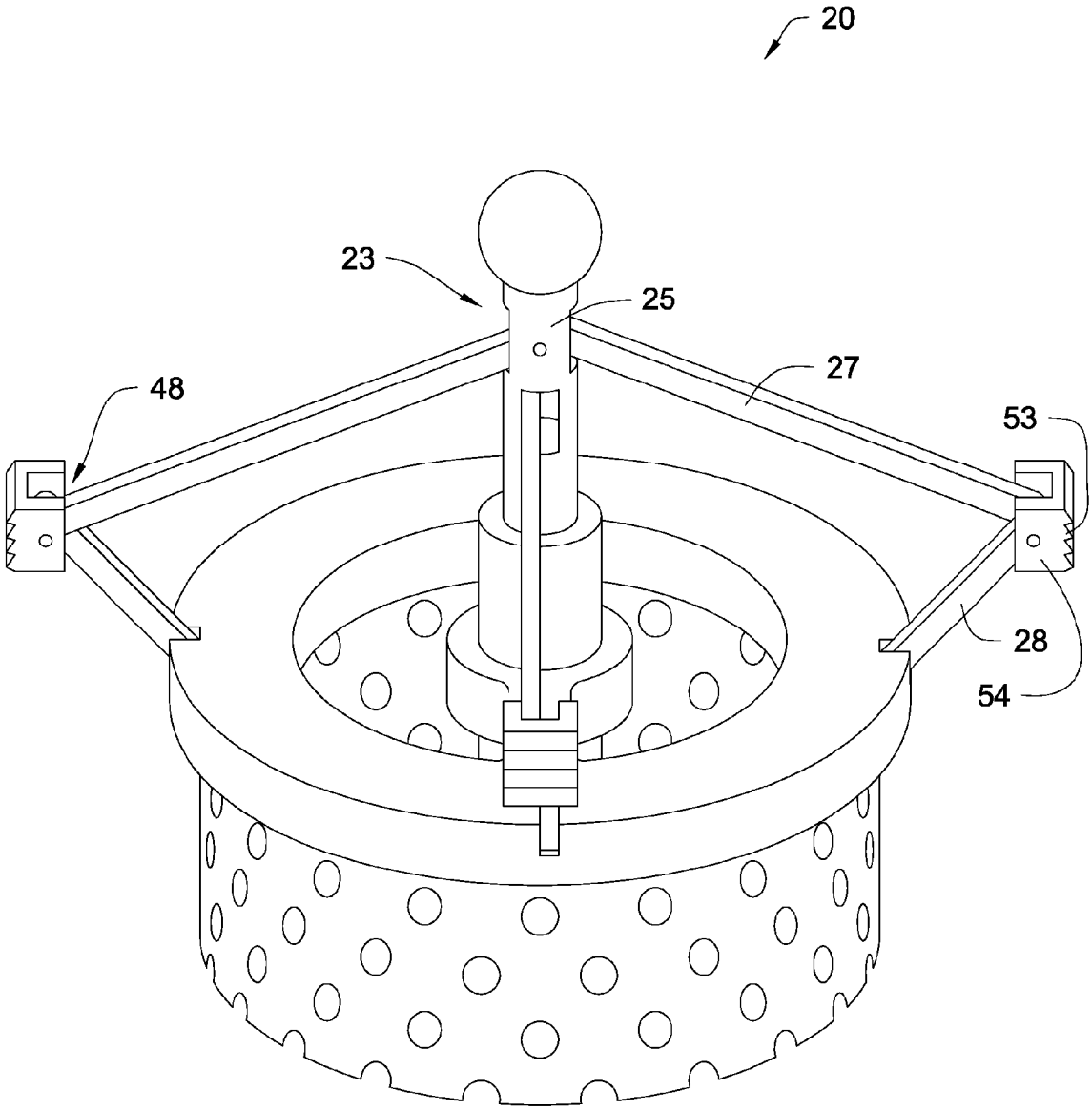
FIG. 6 is a partial perspective view of a filter with articulated struts.

FIG. 6 shows a perspective view of a filter 20 similar to the one disclosed in FIG. 5, but also comprising fasteners 54 with a rough surface 53 attached to the hangers 28 just below the joints 48 connecting the hangers 28 to the linkages 27. The fasteners 54 may contact an internal upset or an internal diameter of a bore wall. The adjustable portion 25 of the mandrel 23 may be positioned so that the fasteners 54 are compressed against the bore wall. The fasteners 54 may be rotated such that they are generally parallel to the hangers 28 or such that they are generally parallel to an internal diameter or an internal upset of the bore wall. In other embodiments, a rough surface 53 may line the hanger 28 to aid in engaging a bore wall.

Figure 7:
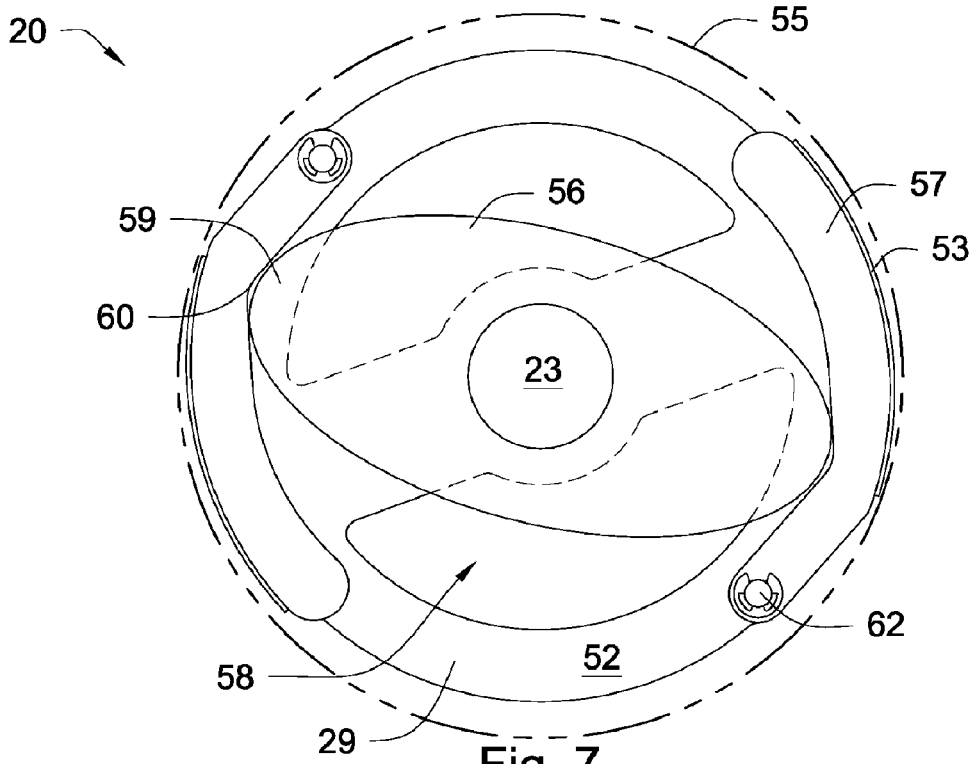
FIG. 7 is a top view of a filter comprising a cam in a disengaged position.
Figure 8:
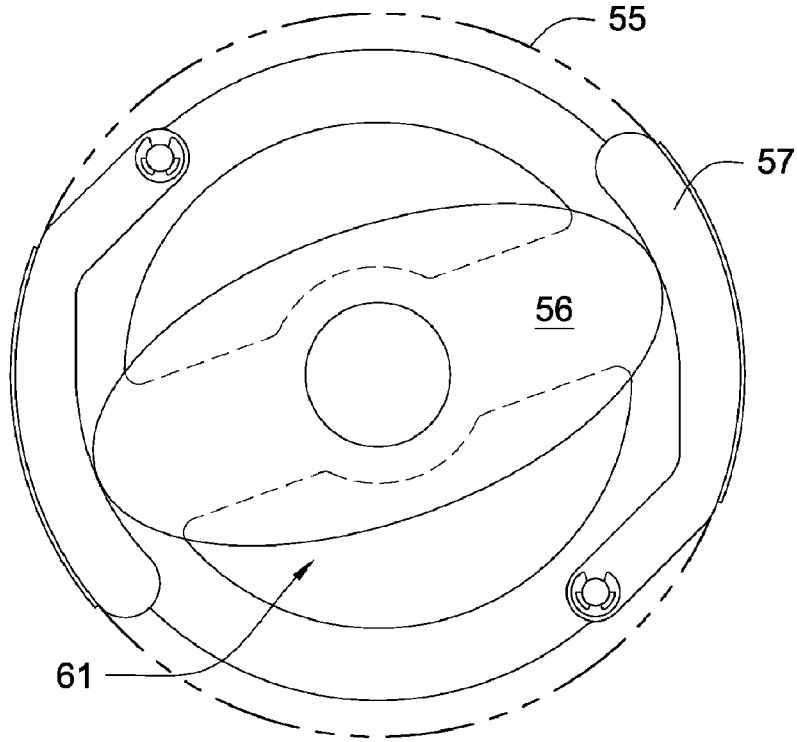
FIG. 8 is a top view of a filter comprising a cam in an engaged position.

FIG. 7 shows a top view of a filter 20. A dotted line 55 represents the bore wall 35 (shown in FIGS. 1 and 2). The mandrel 23 comprises a mechanical attachment to a cam 56, which rotates coaxially with the mandrel 23. The cam 56 interfaces locks 57 attached to edge 52 of the perforated receptacle 29 by a pivot 62. The distal side of the locks 57 comprises a rough surface 53 to aid in engaging the bore wall 35. In FIG. 7, the cam 56 comprises a disengaged position 58 and the ends 59 of the cams 56 are disposed in a bend 60 of the locks 57. As the mandrel 23 rotates, the cam 56 also rotates such that the ends 59 of the cam 56 slide out of the bends 60 pushing the locks 57 outward and the locks 57 engage the bore wall 35. FIG. 8 shows the cam 56 in an engaging position 61, such that the locks 57 are compressed against the bore wall 55.

Figure 9:
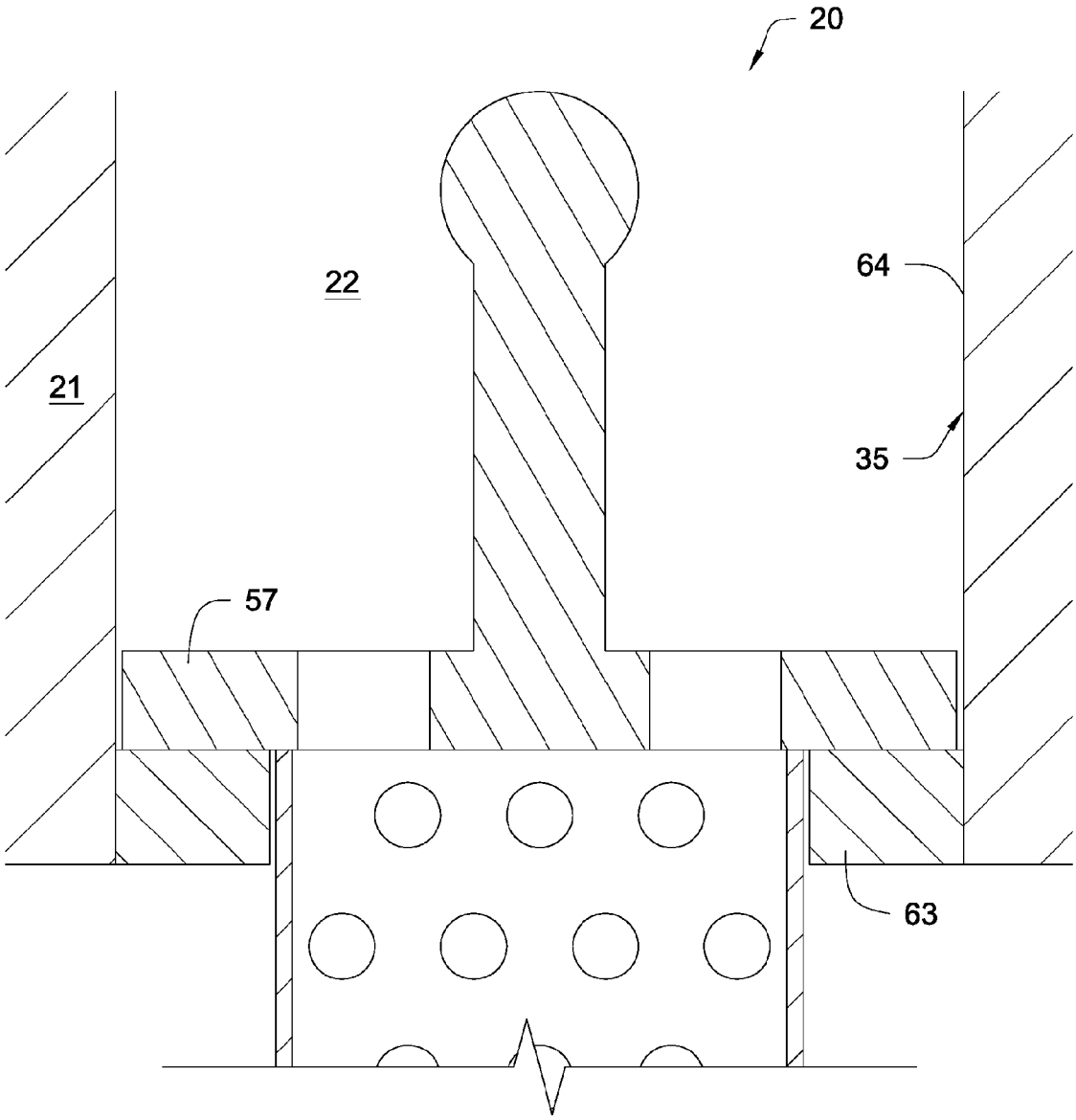
FIG. 9 is a partial orthogonal view of a filter engaging a bore in a cross section of a drill string component.

FIG. 9 shows a filter 20 engaged against an internal shoulder 63 of the bore wall 35. The internal shoulder 63 may be a ring inserted into the bore 22 of the drill string component 21. The ring may be screwed, glued, welded, or press-fitted to the bore wall 35. The ring may also be held in the bore 22 by compression or any other known way to attach rings in a bore 22 known to those of ordinary skill in the art. Further the internal shoulder 63 may by formed in the bore 22 of the drill string component 21 during the manufacture of the drill string component 21. In this embodiment, locks 57 are expanded outward and rest on the internal shoulders 63, but are not compressed to the internal diameter 64 of the bore wall 35. In other embodiments, the locks 57 may rest on the internal shoulder 63 and also compress against the internal diameter 64. The locks 57 may also compress against the internal diameter 64 of the bore wall 35 above the internal shoulder 63, such that the internal shoulder 63 may back up the locks 57 held in compression if the compression is not strong enough to keep the filter 20 from slipping down the bore wall 35.

Figure 10:
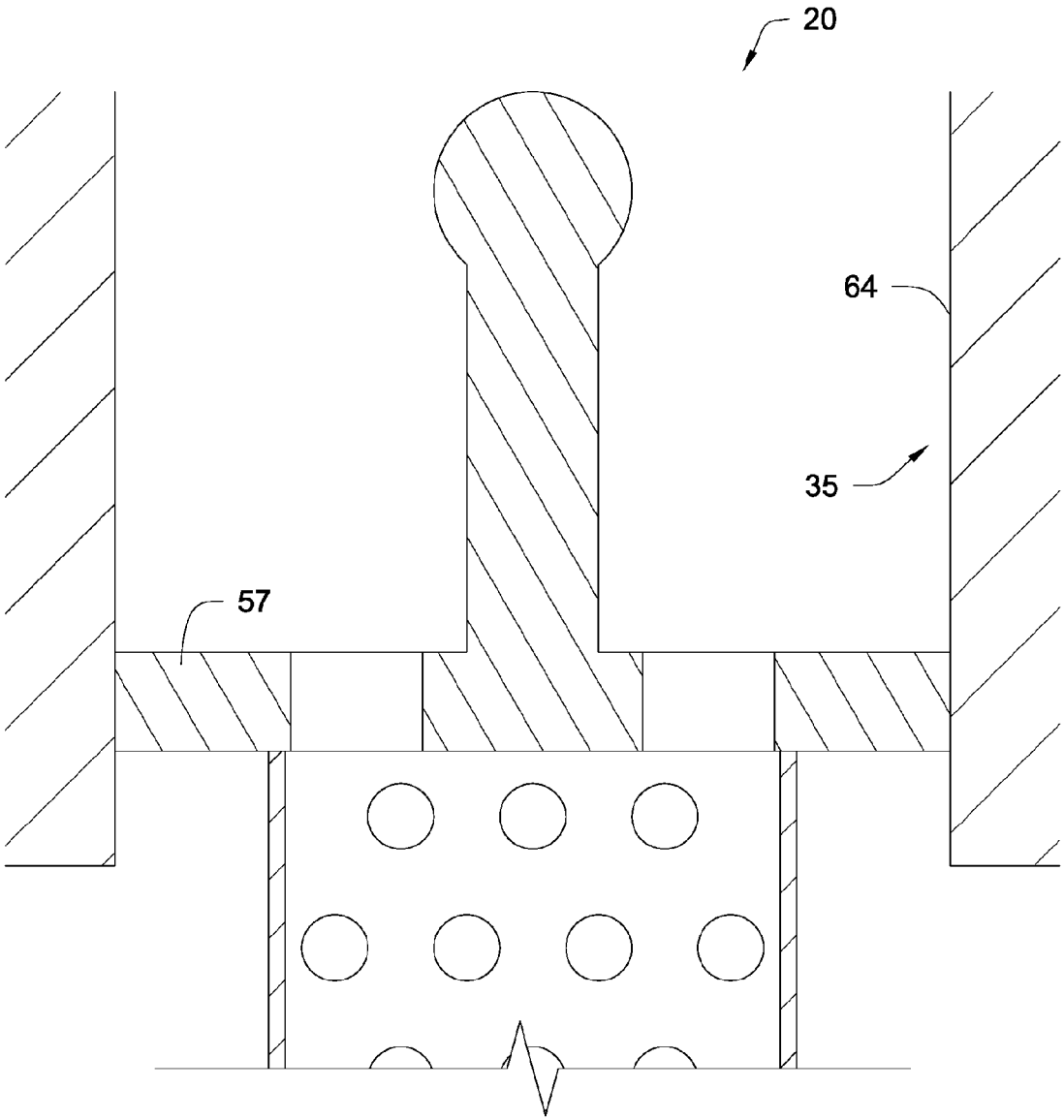
FIG. 10 is a partial orthogonal view of a filter engaging a bore in a cross section of a drill string component.
Figure 11:
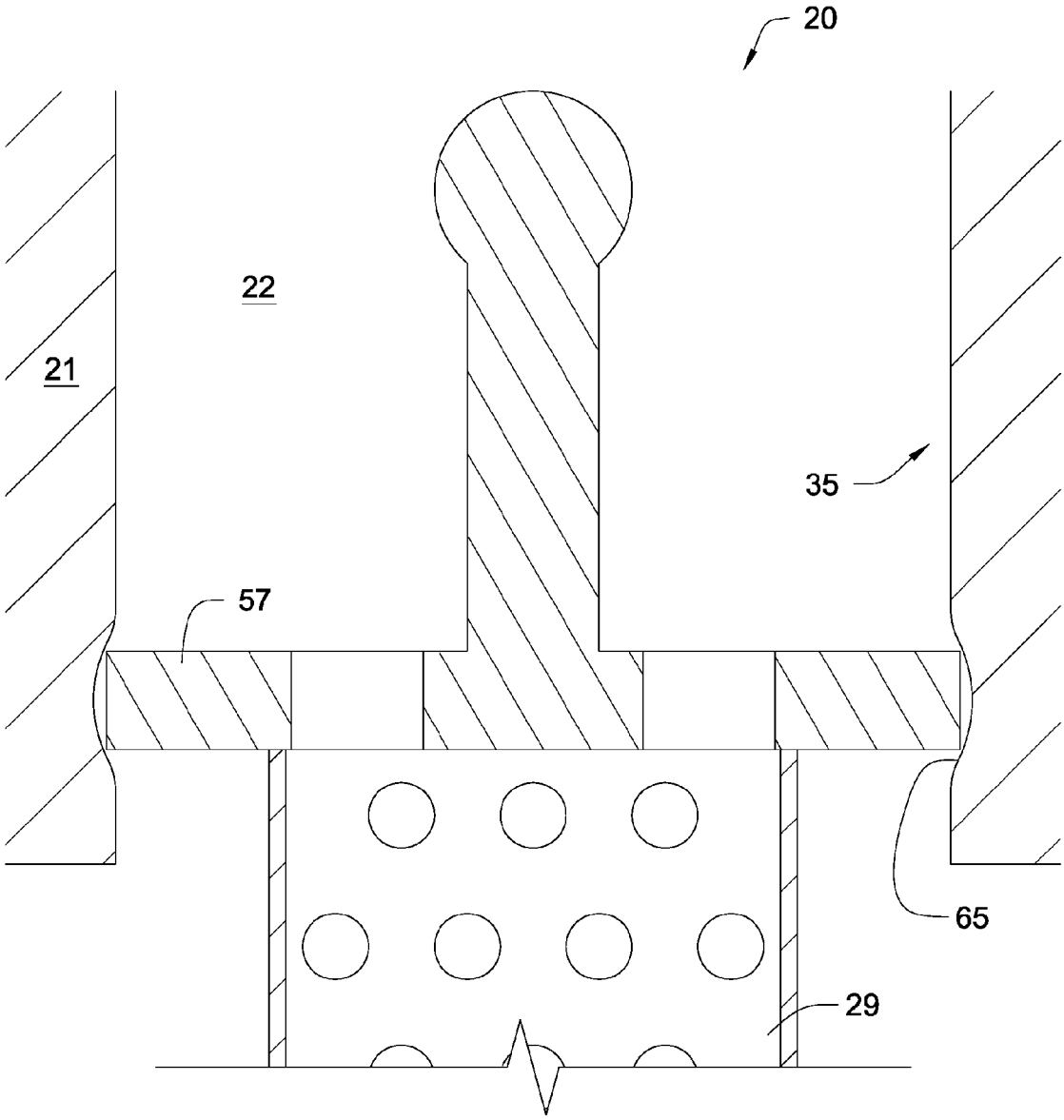
FIG. 11 is a partial orthogonal view of a filter engaging a bore in a cross section of a drill string component.

FIG. 10 shows a filter 20 comprising locks 57 compressed against the internal diameter 64 of the bore wall 35. FIG. 11 shows a filter 20 comprising locks 57 compressed into a groove 65 formed in the bore wall 35 of the drill string component 21. The grooves 65 help prevent the filter 20 from slipping down the bore 22 of the drill string component 21. The filter 20 may slip due to the force of the drilling fluid or added weight from the collected debris in the perforated receptacle 29.

Figure 12:
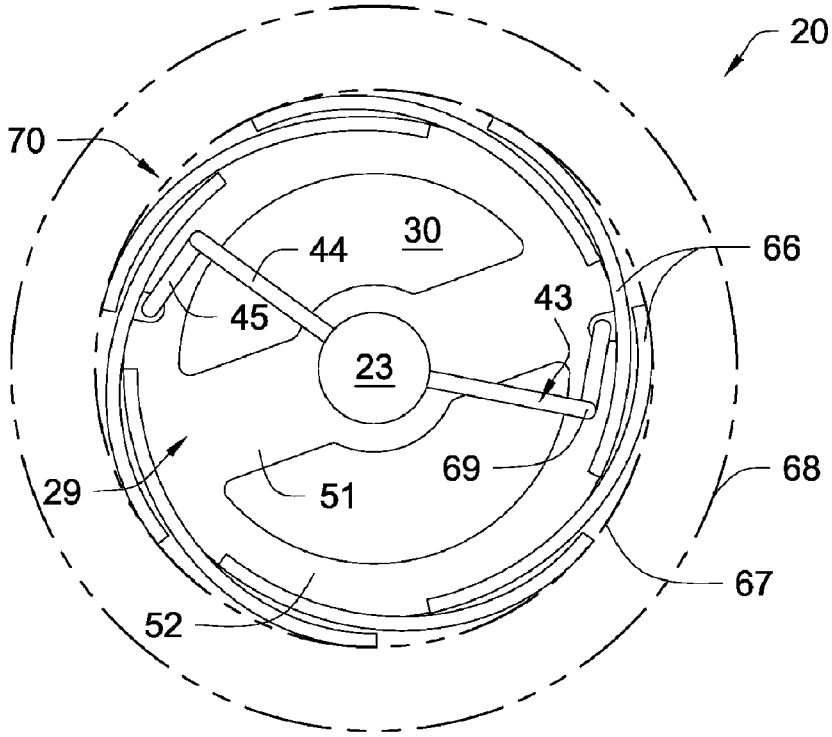
FIG. 12 is a top view of a filter comprising a plurality of overlapping plates in a disengaged position.
Figure 13:
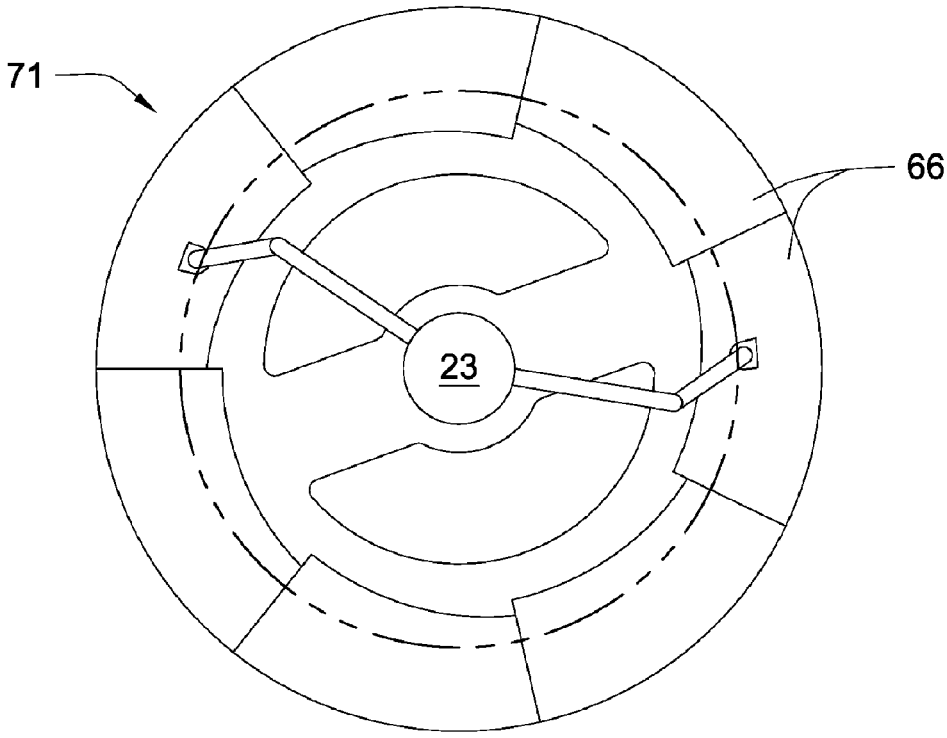
FIG. 13 is a top view of a filter comprising a plurality of overlapping plates in an engaged position.

FIG. 12 is a top view of a filter 20 comprising a circular configuration of a plurality of overlapping plates 66 attached to the edge 52 of the open end 30 of the perforated receptacle 29. The inner and outer dotted lines 67, 68 represent a first and second diameter 33, 34 (shown in FIG. 1) intermediate an internal upset 32 (also shown in FIG. 1). The mandrel 23 is located centrally within the bore 22 (shown in FIG. 1) of the drill string component 21 (also shown in FIG. 1) and attached to the open end 30 of the perforated receptacle 29 via the bridge 51. Intermediate articulated struts 43 comprise a first segment 44 attached to the mandrel 23 and a second segment 45 attached to at least one of the overlapping plates 66. The first and second segments 44, 45 are attached by an angled joint 69. As the mandrel 23 rotates, the first segment 44 moves in a circular direction pushing on the second segment 45, which pushes the overlapping plates 66 outward. Since all of the plates 66 overlap each other, all of the plates 66 are expanded outward. FIG. 12 shows the overlapping plates 66 in a disengaged position 70. FIG. 13 shows the overlapping plates 66 in an engaged position 71, such that the overlapping plates 66 expand to the second diameter 34 of the internal upset 32, wherein the overlapping plates 66 may engage the internal upset 32 of the drill string component 21.

Whereas the present invention has been described in particular relation to the drawings attached hereto, it should be understood that other and further modifications apart from those shown or suggested herein, may be made within the scope and spirit of the present invention.

What is claimed is:

1. A drilling fluid filter for placement within a bore wall of a tubular drill string component, comprising; a perforated receptacle comprising an open end and a closed end; a hanger for engagement with the bore wall mounted at the open end of the perforated receptacle; a mandrel attached to the perforated receptacle adjacent the open end; and a linkage connecting the mandrel and the hanger; wherein the mandrel operates upon the hanger through the linkage to compressively engage and disengage the drilling fluid filter against the bore wall.

2. The filter of claim 1 wherein the drill string component is selected from the group consisting of drill pipes, internally upset drill pipes, swivels, drill collars, and downhole tools.

3. The filter of claim 1 wherein the perforated receptacle comprises a generally cylindrical shape, a generally rectangular shape, a generally conical shape, an amorphous shape, or a generally spherical shape.

4. The filter of claim 1 wherein the closed end of the receptacle is perforated.

5. The filter of claim 1 wherein the mandrel extends beyond the closed end.

6. The filter of claim 1 wherein the mandrel extends beyond the open end.

7. The filter of claim 1 wherein the mandrel comprises an interface for top-hole equipment.

8. The filter of claim 1 wherein the mandrel comprises a stationary portion with a first attachment to the open end of the perforated receptacle and a telescopic adjustable portion compnsing a second attachment to the linkage.

9. The filter of claim 1 wherein the mandrel is coaxially rotatable.

10. The filter of claim 1 wherein the linkage is selected from the group consisting of struts, articulated struts and cams.

11. The filter of claim 1 wherein the hanger comprises an engaging surface selected from the group consisting of rough surfaces, locks, struts, or pluralities of overlapping plates.

12. The filter of claim 1 wherein the hanger is fixed against an internal shoulder of the bore wall, an internal upset of the bore wall, a groove in the bore wall, or an internal diameter of the bore wall.

13. The filter of claim 1 wherein the hanger is fixed against an internal shoulder of the bore wall, an internal upset of the bore wall, grooves in the bore wall, or an internal diameter of the bore wall.

14. A drilling fluid filter for placement within a bore wall of a tubular drill string component, comprising; a perforated receptacle comprising an open end and a closed end; a hanger for engagement with the bore wall mounted at the open end of the perforated receptacle; a linkage connecting the hanger and to a mandrel; and the mandrel comprising a stationary portion with a first attachment to the open end of the receptacle via a bridge and a telescopic adjustable portion with a second attachment the linkage; wherein the mandrel operates upon the hanger through the linkage to compressively engage and disengage the drilling fluid filter against the bore wall.

15. The filter of claim 14 wherein the drill string component is selected from the group consisting of drill pipes, internally upset drill pipes, swivels, drill collars, and downhole tools.

16. The filter of claim 14 wherein the perforated receptacle comprises a generally cylindrical shape, a generally rectangular shape, a generally conical shape, an amorphous shape, or a generally spherical shape.

17. The filter of claim 14 wherein the mandrel extends beyond the closed end.

18. The filter of claim 14 wherein the mandrel extends beyond the open end.

19. The filter of claim 14 wherein the linkage is selected from the group consisting of struts, articulated struts and cams.

20. The filter of claim 14 wherein the hanger comprises an engaging surface selected from the group consisting of rough surfaces, locks, struts, or pluralities of overlapping plates.

* * * * *